US008740448B2

(12) United States Patent
Blom et al.

(10) Patent No.: US 8,740,448 B2
(45) Date of Patent: Jun. 3, 2014

(54) MICROMIXING CHAMBER, MICROMIXER COMPRISING A PLURALITY OF SUCH MICROMIXING CHAMBERS, METHODS FOR MANUFACTURING THEREOF, AND METHODS FOR MIXING

(76) Inventors: Marko Theodoor Blom, Enschede (NL); Michael Christiaan Mulder, Enschede (NL); Jordan Macleod Macinnes, Sheffield (GB); Raymond William Kenneth Allen, Boars Hill (GB)

( * ) Notice: Subject to any disclaimer, the term of this patent is extended or adjusted under 35 U.S.C. 154(b) by 1428 days.

(21) Appl. No.: 12/513,602

(22) PCT Filed: Nov. 5, 2007

(86) PCT No.: PCT/NL2007/000276

§ 371 (c)(1),
(2), (4) Date: Oct. 29, 2009

(87) PCT Pub. No.: WO2008/056975

PCT Pub. Date: May 15, 2008

(65) Prior Publication Data

US 2010/0067323 A1 Mar. 18, 2010

(30) Foreign Application Priority Data

Nov. 6, 2006 (NL) ..... 1032816

(51) Int. Cl.
*B01F 5/00* (2006.01)
*B01F 5/06* (2006.01)
*B01F 13/00* (2006.01)

(52) U.S. Cl.
USPC ..... 366/165.1; 366/340

(58) Field of Classification Search
USPC ..... 366/340, 165.2, 165.1
See application file for complete search history.

(56) References Cited

U.S. PATENT DOCUMENTS

| | | | | | |
|---|---|---|---|---|---|
| 3,251,653 | A | * | 5/1966 | Aditya | 422/224 |
| 3,261,593 | A | * | 7/1966 | Sharples | 366/165.2 |
| 3,881,701 | A | * | 5/1975 | Schoenman et al. | 239/403 |
| 4,337,315 | A | * | 6/1982 | Fukushima et al. | 435/296.1 |
| 4,480,925 | A | * | 11/1984 | Dietrich | 366/107 |
| 4,687,643 | A | * | 8/1987 | Cortesi et al. | 422/150 |
| 4,726,686 | A | * | 2/1988 | Wolf et al. | 366/165.1 |
| 4,790,666 | A | * | 12/1988 | Koziol | 366/165.1 |
| 5,573,334 | A | * | 11/1996 | Anderson | 366/162.4 |
| 5,695,648 | A | * | 12/1997 | Fassbender et al. | 210/739 |

(Continued)

FOREIGN PATENT DOCUMENTS

| | | | |
|---|---|---|---|
| WO | 03/011443 | A2 | 2/2003 |
| WO | 2004/054696 | A1 | 7/2004 |
| WO | 2005/063368 | A2 | 7/2005 |

*Primary Examiner* — Tony G Soohoo
(74) *Attorney, Agent, or Firm* — The Webb Law Firm

(57) ABSTRACT

A micromixing chamber, roughly in the form of an hourglass, having a first outer end with a tangential inflow opening and a second outer end with a tangential outflow opening. The mixing chamber in the overall flow direction first narrows more or less gradually and subsequently widens more or less abruptly. The micromixer may be made at least partially of glass, or at least partially of a plurality of glass plates. A micromixer having a plurality of such micromixing chambers connected fluidically in series is also disclosed. Methods for manufacturing such a micromixing chamber of such a micromixer, as well as method for mixing by means of such a micromixing chamber or by means of such a micromixer, are disclosed.

22 Claims, 5 Drawing Sheets

(56) References Cited

U.S. PATENT DOCUMENTS

| | | | | |
|---|---|---|---|---|
| 5,886,112 | A * | 3/1999 | Vuillemin et al. | 526/64 |
| 5,904,424 | A * | 5/1999 | Schwesinger et al. | 366/336 |
| 6,004,517 | A * | 12/1999 | Tirtowidjojo et al. | 422/129 |
| 6,270,641 | B1 * | 8/2001 | Griffiths et al. | 204/451 |
| 6,331,073 | B1 * | 12/2001 | Chung | 366/341 |
| 6,655,829 | B1 * | 12/2003 | Vanden Bussche et al. | 366/165.1 |
| 6,863,867 | B2 * | 3/2005 | Vanden Bussche et al. | 422/129 |
| 6,935,768 | B2 * | 8/2005 | Lowe et al. | 366/167.1 |
| 7,018,435 | B1 * | 3/2006 | Wentinck | 48/198.8 |
| 7,097,347 | B2 * | 8/2006 | Vanden Bussche et al. | 366/165.1 |
| 7,160,025 | B2 * | 1/2007 | Ji et al. | 366/341 |
| 8,277,110 | B2 * | 10/2012 | Lee et al. | 366/134 |
| 2001/0048900 | A1 * | 12/2001 | Bardell et al. | 422/100 |
| 2002/0197733 | A1 * | 12/2002 | Bohm et al. | 436/180 |
| 2003/0070833 | A1 * | 4/2003 | Barth et al. | 174/250 |
| 2003/0123322 | A1 * | 7/2003 | Chung et al. | 366/165.1 |
| 2003/0128813 | A1 * | 7/2003 | Appleby et al. | 378/147 |
| 2003/0165079 | A1 * | 9/2003 | Chen et al. | 366/165.1 |
| 2004/0047767 | A1 * | 3/2004 | Bergman et al. | 422/99 |
| 2004/0125689 | A1 * | 7/2004 | Ehrfeld et al. | 366/165.1 |
| 2004/0126254 | A1 * | 7/2004 | Chen et al. | 417/423.1 |
| 2006/0079003 | A1 | 4/2006 | Witty et al. | |
| 2006/0087918 | A1 * | 4/2006 | Ji et al. | 366/341 |
| 2010/0067323 | A1 * | 3/2010 | Blom et al. | 366/165.2 |
| 2013/0028841 | A1 * | 1/2013 | Yagi et al. | 424/9.1 |

* cited by examiner

MICROMIXING CHAMBER, MICROMIXER COMPRISING A PLURALITY OF SUCH MICROMIXING CHAMBERS, METHODS FOR MANUFACTURING THEREOF, AND METHODS FOR MIXING

BACKGROUND OF THE INVENTION

1. Field of the Invention

The invention relates to a micromixing chamber. The invention also relates to a micromixer comprising a plurality of such micromixing chambers connected fluidically in series. The invention further relates to a method for manufacturing such a micromixing chamber, and a method for manufacturing such a micromixer. The invention also relates to a method for mixing by means of such a micromixing chamber, and a method for mixing by means of such a micromixer. In the context of the invention 'micromixing chamber' and 'micromixer' are understood to mean: 'microstructural mixing chamber' and 'microstructural mixer', wherein 'microstructural' is defined within the context of the present invention as: comprising at least one essential element or essential formation characterized by the very small size thereof, in particular within the range of $10^{-3}$ to $10^{-7}$ meter. The invention can advantageously be applied particularly in the field of microfluidics, in which the flows are generally of laminar nature.

2. Description of Related Art

Microfluidics is concerned with microstructural devices and systems with fluidic functions. This may relate to the manipulation of very small quantities of liquid or gas in the order of microliters, nanoliters or even picoliters. Important applications lie in the field of biotechnology, chemical analysis, medical testing, process monitoring and environmental measurements. A more or less complete miniature analysis system or synthesis system can herein be realized on a microchip, a so-called 'lab-on-a-chip', or in specific applications a so-called 'biochip'. The device or the system can comprise microchannels, mixers, reservoirs, diffusion chambers, integrated electrodes, pumps, valves and so forth. The microchip is usually constructed from one or more layers of glass, silicon or a plastic such as a polymer. Glass in particular is highly suitable for many applications due to a number of properties. Glass has thus been known for many centuries and many types and compositions are readily available at low cost. In addition, glass is hydrophilic, chemically inert, stable, optically transparent, non-porous and suitable for prototyping; properties which in many cases are advantageous or required.

In many fluidic devices one or more volumes or flows have to be mixed. The Reynolds number, which indicates the ratio between the occurring inertia forces and viscous forces, will generally be so low in microfluidic devices, usually a maximum of about 500, that we are dealing with laminar flow and turbulence cannot be achieved, so that in principle mixing of flowing volumes does not occur. In order to nevertheless bring about mixing it is possible to make use of active or passive mixing. Active or dynamic micromixers comprise moving parts which set the relevant media into motion, although this is also possible by applying for instance pressure differences or with ultrasound. Such mixers are however complex and often difficult to make, and therefore expensive. In passive or static micromixers flows are 'folded and deformed' by opting for a determined geometry and specific dimensions of the channels, tunnels, passages and so on such that the interfaces between volumes are enlarged. The diffusion areas will thus be enlarged and the diffusion distances will decrease, whereby mixing by diffusion is more likely.

The flows can here for instance be split, rotated and subsequently recombined, see for instance WO 2005/063368. Diffusion can also be enhanced by bringing about a transverse flow component, i.e. perpendicularly of the main direction of a flow, by means of grooves or protrusions arranged for this purpose in the wall of a microfluidic channel, see WO 03/011443. Many more other embodiments of passive or static micromixers are thus known, to be found for instance in patent documents classified in B01F13/00M (European classification).

Design variables in passive or static micromixers are the geometry and the dimensions of channels, tunnels, passages and so on. Together with the properties of the media and components involved (viscosity, density and diffusivity) and the flow rate, these determine the pressure drop over the mixer, the values of the Reynolds number, the flow regime, the values of the Peclet number, the mixing regime, the efficiency (mixing achieved), the speed (time required), the number of mixing elements required and the necessary volume or area ('footprint'). It is possible to attempt to achieve a better mixing by operating at higher Reynolds numbers greater than 500, but it will usually then be no longer possible to meet stricter specifications in respect of pressure drop, speed, volume and footprint. A micromixer is thus described in WO 2004/054696 which comprises a first mixing chamber and a second mixing chamber which are mutually connected by means of a connecting channel which is relatively narrow and long in relation to the chambers. The liquid is caused to flow tangentially via a feed channel into the first mixing chamber and to flow tangentially via a discharge channel out of the second mixing chamber such that a circulating, more or less planar flow is created in each chamber, wherein the flow directions are opposed in the two mixing chambers. This can result in a good mixing but, due to the relatively wide and low mixing chambers and due to the relatively narrow and long connecting channel, the pressure drop over such a micromixer is great, as are the required footprint and the total volume of the micromixer. US 2006/079003 specifies a conical mixing chamber which tapers in the flow direction and in which a flow is created in the form of a narrowing helix. The thus achieved mixing is however found to be too limited for many applications.

There therefore exists a need for an improved passive or static micromixer with a higher efficiency, a higher speed, a small number of required mixing elements, a smaller volume and footprint, and a lower pressure drop than the usual micromixers. This is preferably compatible here with known microfluidic devices and can be manufactured from materials usual for the purpose, such as glass, preferably by means of techniques usual in the relevant field, such as powder blasting, etching and bonding. The object of the invention is to fulfil this need.

SUMMARY OF THE INVENTION

The invention provides for this purpose a micromixing chamber, roughly in the form of an hourglass which is provided at a first outer end with a tangential inflow opening and at a second outer end with a tangential outflow opening, which mixing chamber in the overall flow direction first narrows more or less gradually and subsequently widens more or less abruptly, and a micromixer comprising a plurality of such micromixing chambers connected fluidically in series. It is found in practice that it is possible to design such a micromixing chamber or micromixer such that it is possible, also for higher Reynolds numbers, to satisfy more stringent specifications in respect of efficiency, speed, number of mixing elements, volume and footprint and pressure drop. A circulating flow in the form of a helix is formed in a micromixing chamber. A circulating movement forming the beginning of the helix is created in a first part. The circulating movement is gradually accelerated by the more or less gradual narrowing. The gradualness is important in keeping the overall pressure drop over the micromixing chamber within limits. A more or less abrupt widening of the rapidly rotating helix then takes place which is found to provide an additionally good mixing. It is thus found possible to achieve a very efficient and rapid mixing. Micromixing chambers and micromixers according to the invention can of course be connected in series and/or in parallel in diverse ways as required.

The invention also provides methods for manufacturing a micromixing chamber according to the invention and a micromixer according to the invention. The micromixing chamber or micromixing chambers and the required channels, tunnels, passages and so on are here preferably arranged by means of powder blasting. Etching, drilling, milling and so forth are however also possible. Such techniques are much used in the manufacture of microfluidic devices. Furthermore, use can advantageously be made of the 'blast-lag' phenomenon, for instance for manufacturing in a single process run shallower, narrower channels and deeper, wider structures, holes or passages, optionally combined with the phenomenon of 'mask erosion', for instance for manufacturing the specific hourglass form. This will be further discussed in the following more detailed description of an exemplary embodiment of a micromixer according to the invention. A micromixing chamber according to the invention can be constructed at least partially from a plurality of plates, preferably of glass, for instance three plates, wherein a first space is arranged in a first plate, a second, preferably tapering space is arranged in a second plate and a third space is arranged in a third plate such that the three spaces together have roughly the desired hourglass-like form with more or less abrupt widening. Glass is preferably used as material because of the good properties thereof already mentioned above. It is noted here that in the context of the present invention the term 'glass' also includes glass-like materials. Other materials, preferably compatible with microstructural technology and microfluidics in particular, can however also be advantageously applied in specific cases. Silicon, polymers, stainless steel, molybdenum and determined alloys can for instance be envisaged here.

The invention also provides a method for mixing by means of a micromixing chamber according to the invention and a method for mixing by means of a micromixer according to the invention.

BRIEF DESCRIPTION OF THE DRAWINGS

The invention is elucidated hereinbelow on the basis of a non-limitative exemplary embodiment of a micromixer according to the invention.

For this purpose.

DETAILED DESCRIPTION OF THE INVENTION

Figure 1:
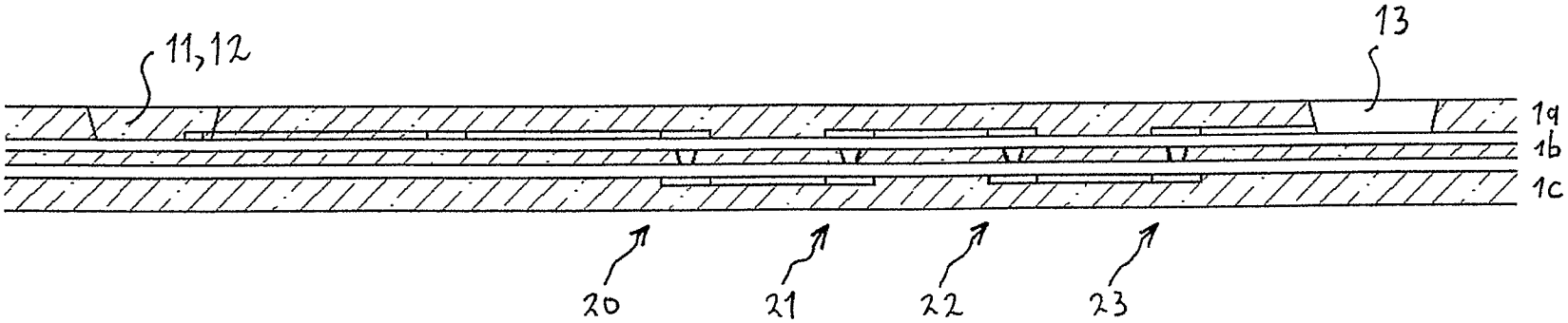
FIG. 1 shows a longitudinal section of the three glass plates, in unassembled state, from which the micromixer is constructed.
Figure 2:
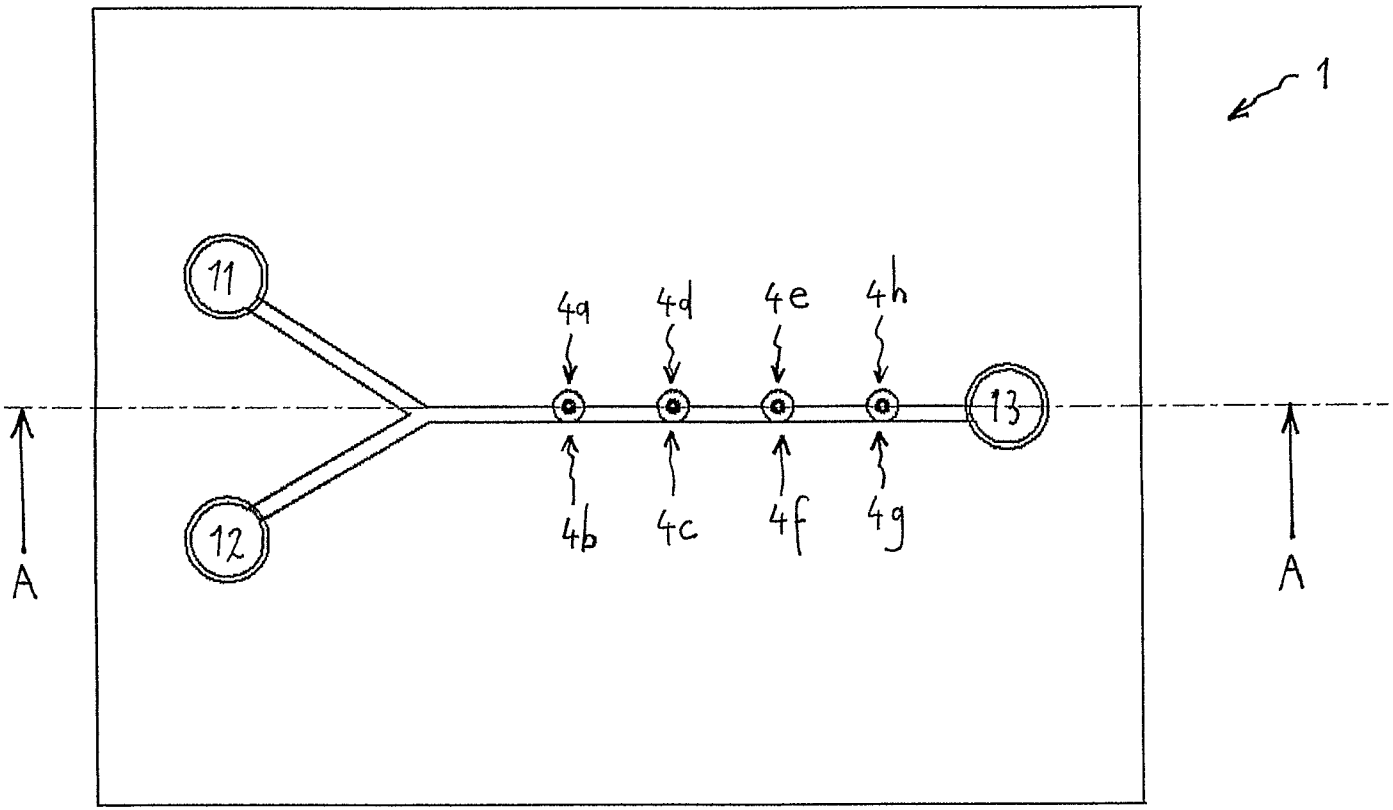
FIG. 2 is a top view of the micromixer.
Figure 3:
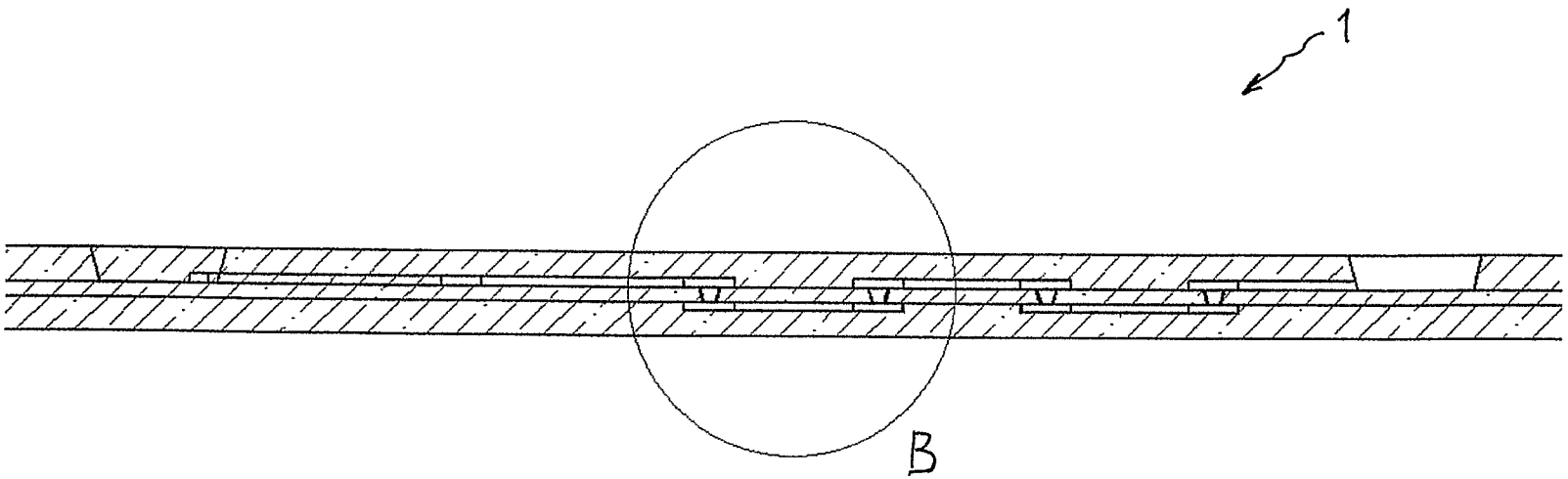
FIG. 3 shows a longitudinal section of the micromixer along the plane A-A indicated in FIG. 2.
Figure 4:
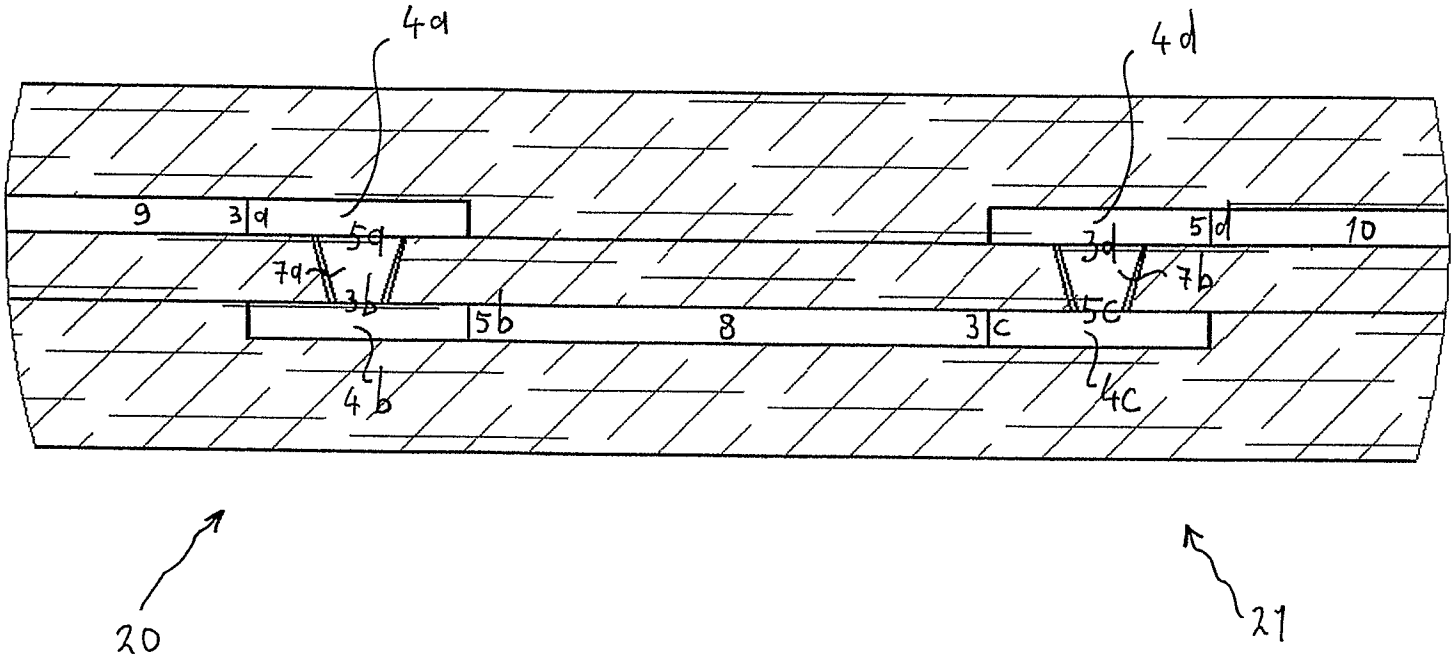
FIG. 4 shows a part, indicated with B in FIG. 3, of this longitudinal section.
Figure 5:
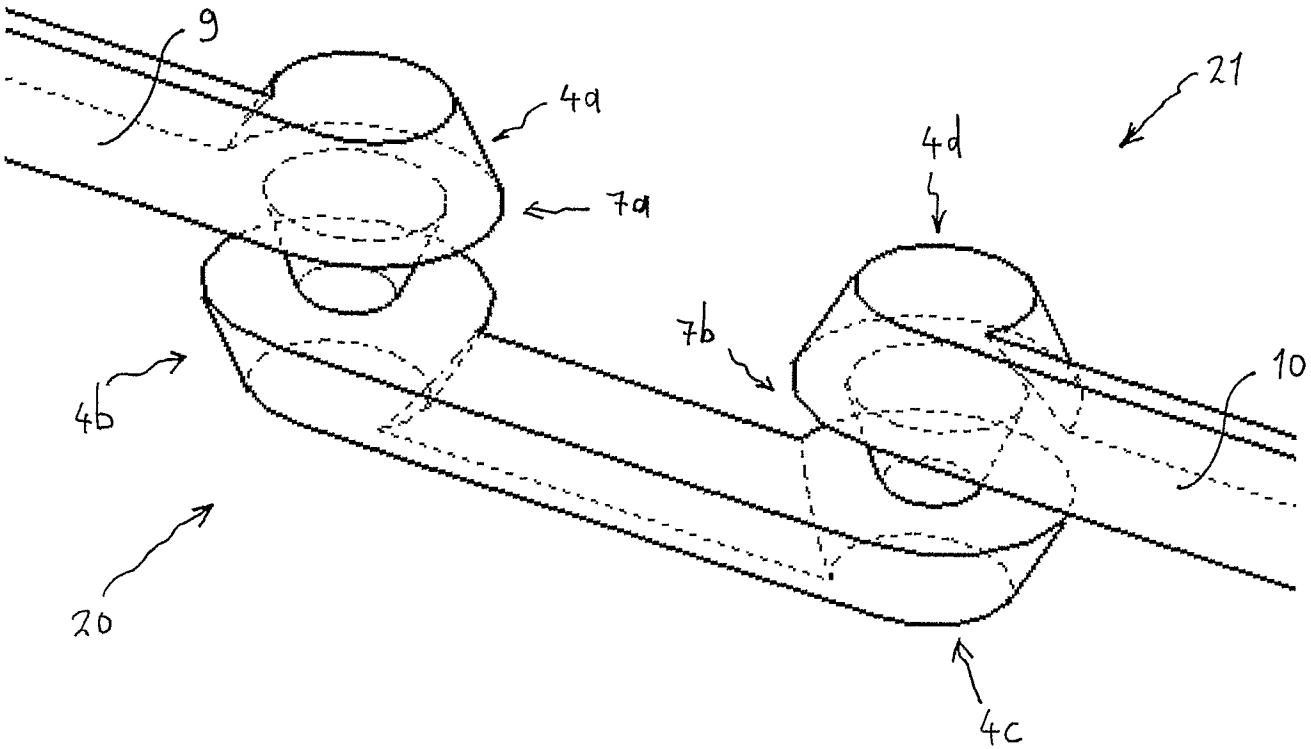
FIG. 5 shows a more or less schematic perspective view of this part of the micromixer.

The exemplary embodiment of a micromixer (1) according to the invention shown in the figures comprises four micromixing chambers (20-23) according to the invention, each comprising an inflow opening and an outflow opening. A volume flowing tangentially through a first inflow opening (3*a*) into a first micromixing chamber (20) is forced to follow a more or less helical path in first micromixing chamber (20) and to flow tangentially out of first micromixing chamber (20) through a first outflow opening (5*b*). During transport through first micromixing chamber (20) the volume is 'folded' in a first part (4*a*) of micromixing chamber (20), 'stretched' in a second part (7*a*) and 'expands' in a third part (4*b*), wherein a good mixing takes place. In the given exemplary embodiment the rotation direction of the helix is constant over the whole micromixing chamber (20). The rotation direction in the third part (4*b*) can optionally be in the opposite direction, for instance through different placing of first outflow opening (5*b*).

Via a fluidic connection in the form of a longer channel or tunnel (8) the volume flows tangentially through a second inflow opening (3*c*) into a second micromixing chamber (21). In second micromixing chamber (21) the volume is again forced to follow a more or less helical path and to then flow tangentially out of second micromixing chamber (21) through a second outflow opening (5*d*). During transport through second micromixing chamber (21) the volume is again 'folded' and 'stretched' and 'expands', wherein a further mixing takes place. The volume then flows through two other micromixing chambers (22,23) and is here mixed still further.

The cross-section of mixing chambers (20-23) varies in the given exemplary embodiment from 400 μm at the outer ends to 150 μm at the narrowest point, and their height is 475 μm. The width and height of channels (8,9,10) amount respectively to 200 μm and 150 μm.

It is found in practice that a very good mixing can be achieved in a short time using the micromixer according to the invention. In determined cases it is possible to suffice with a single micromixing chamber. The number of mixing chambers required will of course depend on the desired final mixing. Using a micromixing chamber or micromixer according to the invention a much better mixing can be achieved compared to known micromixers, particularly at higher Reynolds numbers. The higher the Reynolds numbers, the greater will be the ratio between inertia forces and viscous forces, and the sooner and more completely the forming of a circulating or helical flow and the 'folding' will occur in a micromixing chamber. The 'stretching' and acceleration of the circulating movement and the subsequent 'expansion' is found to bring about a very good and rapid mixing. It is further noted that the flows in the micromixer will in principle be laminar everywhere, but that local turbulence can also occur in determined cases.

In addition to the given exemplary embodiment (1), diverse other combinations, in series and/or in parallel, of one or more micromixing chambers and/or one or more micromixers are of course also possible according to the invention. A number of micromixing chambers can herein be placed in series relatively easily because each micromixing chamber has only one inlet and one outlet, so no additional elements such as splitters are necessary here as in the case of split and recombine mixers.

Micromixer (1) is manufactured by making use of usual microstructural glass technology. Use is made here of a number of glass plates (1*a*,1*b*,1*c*). Realized in the surface of a plate (1*a*,1*c*) are shallow channels which, when covered with another plate (1*b*), form tunnels (8,9,10). Feeds (11,12), discharge (13) and passages (7*a*,7*b*) are also arranged. A technique highly suitable for this purpose is powder blasting using masks. Particularly with glass this is a known and inexpensive technique with which channels and holes or passages can be realized in a single processing step. Roughly the desired hourglass form is thus realized.

Four masks are in principle necessary for the powder blasting in the case of the described micromixer (1): two masks for channels (8,9,10) and the first and third parts (4*a*-4*h*) of micromixing chambers (20-23), one mask for the second parts (7*a*,7*b*) and one mask for the feeds and discharge (11, 12,13). In the powder blasting use can now however advantageously also be made of the phenomenon, normally considered disadvantageous, of blast lag, which means that during powder blasting the depth of narrower structures increases more slowly than the depth of wider structures. In this way shallower, narrower channels as well as deeper, wider structures or passages can be made in a plate in one step using a single mask. In the present case the feeds (11,12) and discharge (12) can thus be realized together with a portion of the channels in a single processing step, which saves a mask and a processing step. The second parts (7*a*,7*b*) of micromixing chambers (20-23) can thus also be realized together with a portion of the channels in a single processing step. In the present case the required number of masks and processing steps can thus be reduced for instance by half, which of course results in great savings in time and cost.

By also making use, in addition to the phenomenon of blast lag, of the phenomenon of mask erosion as described in NL 1034489 in the name of the present applicant, it is possible to more closely approximate the ideal form of a mixing chamber according to the invention and to further reduce the number of plates and production steps required.

The three glass plates (1*a*,1*b*,1*c*) are mounted on top of each other by means of thermal bonding and must therefore be aligned relative to each other with a determined accuracy. This is compatible with the microstructural glass technology used, since auxiliary structures for the alignment can be arranged in the plates without additional processes.

The structure can also be wholly or partially manufactured from other materials, for instance silicon or a polymer. Other microstructural techniques, for instance wet chemical etching, RIE or moulding techniques can also be applied. The processing of the glass may thus be advantageous with a combination of powder blasting, for instance for the passages or holes, and wet chemical etching, for instance for the channels and micromixing chambers. The micromixing chambers and the micromixer can thus be given a much smaller form, which may be useful for instance for research applications. It may be advantageous for determined applications to make use of a material with a high heat conduction, such as a metal or an alloy, for instance stainless steel, hastelloy or molybdenum. It is possible to envisage micromixers wherein it must be possible to heat a reaction mixture quickly or, for instance in the case of an exothermic reaction, it must be possible to discharge heat quickly.

The use of glass is generally advantageous because it is an inert and optically transparent material which can withstand high temperatures. In many chemical reactions a good mixing is thus important, the reactants and/or the reaction products may be corrosive, and the reaction can take place at high temperature. The use of glass then has considerable advantages. The use of glass and powder blasting also has the significant advantage that a greater depth/width ratio of the channels is possible than in the case of wet chemical etching. A greater depth-width ratio is in many cases favourable for the mixing. In wet chemical etching of amorphous materials the depth-width ratio can in principle not be greater than 0.5, while in powder blasting a ratio higher than 1.0 is readily feasible. While a ratio higher than 1.0 can also be achieved with RIE, RIE is a much more expensive technique than powder blasting.

It will be apparent that the invention is by no means limited to the given exemplary embodiment, but that many variants are possible within the scope of the invention.

The invention claimed is:

1. A micromixing chamber, roughly in the form of an hourglass, comprising a first outer end with a circular cross section and a tangential inflow opening and a second outer end with a circular cross section and a tangential outflow opening, wherein the mixing chamber comprises a tapering mixing space between the first outer end and the second outer end that tapers in the direction of the second outer end, such that in the overall flow direction said mixing chamber first narrows gradually and subsequently widens abruptly.

2. The micromixing chamber of claim 1, wherein the micromixing chamber is at least partially comprised of glass.

3. The micromixing chamber of claim 1, wherein the micromixing chamber is constructed at least partially from a plurality of plates.

4. The micromixing chamber of claim 3, wherein the micromixing chamber is constructed at least partially from three plates, wherein a first space is arranged in a first plate, a second tapering space is arranged in a second plate, and a third space is arranged in a third plate, these three spaces together having roughly the hourglass-like form.

5. The micromixing chamber of claim 3, wherein the plates are made of glass.

6. A micromixer comprising a plurality of micromixing chambers as claimed in claim 1, the micromixing chambers being connected fluidically in series.

7. The micromixer of claim 6, wherein the micromixer is at least partially comprised of glass.

8. The micromixer of claim 6, wherein the micromixer is constructed at least partially from a plurality of plates.

9. The micromixer of claim 8, wherein the plates are made of glass.

10. A method for mixing by means of a micromixer as claimed in claim 6, wherein the method comprises the step of causing a fluid to flow into a micromixing chamber through an inflow opening.

11. The micromixer of claim 6, wherein each micromixing chamber has a first outer end with a single tangential inflow opening configured to receive two or more fluids.

12. A method for mixing by means of a micromixing chamber as claimed in claim 1, wherein the method comprises the step of causing a fluid to flow into the micromixing chamber through the inflow opening.

13. The micromixing chamber of claim 1, wherein the first outer end has a single tangential inflow opening configured to receive two or more fluids.

14. A method for manufacturing a micromixing chamber, roughly in the form of an hourglass, comprising a first outer end with a circular cross section and a tangential inflow opening and a second outer end with a circular cross section and a tangential outflow opening, wherein the mixing chamber comprises a tapering mixing space between the first outer end and the second outer end that tapers in the direction of the second outer end, such that in the overall flow direction said mixing chamber first narrows gradually and subsequently widens abruptly, the method comprising powder blasting the micromixing chamber to form the first outer end with the tangential inflow opening, the second outer end with the tangential outflow opening, and the tapering mixing space.

15. The method of claim 14, wherein the powder blasting of the micromixing chamber utilizes blast lagging.

16. The method of claim 15, wherein the powder blasting of the micromixing chamber utilizes mask erosion.

17. The method of claim 14, further comprising constructing the micromixing chamber at least partially from a plurality of plates prior to powder blasting the micromixing chamber.

18. The method of claim 17, wherein the micromixing chamber is constructed at least partially from three plates, wherein a first space is arranged in a first plate, a second tapering space is arranged in a second plate, and a third space is arranged in a third plate such that the three spaces together having roughly the form of the hourglass.

19. The method of claim 17, wherein the plates are made of glass.

20. A method for manufacturing a micromixer comprising a plurality of micromixing chambers, each of the plurality of micromixing chambers is roughly in the form of an hourglass and comprises a first outer end with a circular cross section and a tangential inflow opening and a second outer end with a circular cross section and a tangential outflow opening, wherein the mixing chamber comprises a tapering mixing space between the first outer end and the second outer end that tapers in the direction of the second outer end such that in the overall flow direction said mixing chamber first narrows gradually and subsequently widens abruptly, the method comprising powder blasting the micromixing chambers to form the first outer end with the tangential inflow opening, the second outer end with the tangential outflow opening, and the tapering mixing space.

21. The method of claim 20, wherein the powder blasting of the micromixing chambers utilizes blast lagging.

22. The method of claim 21, wherein the powder blasting of the micromixing chambers utilizes mask erosion.

* * * * *